United States Patent [19]

Brede et al.

[11] Patent Number: 4,653,211

[45] Date of Patent: Mar. 31, 1987

[54] BREECH MECHANISM FOR A GUN WITH INDUCTIVE IGNITION ENERGY TRANSMISSION SYSTEM

[75] Inventors: Uwe Brede, Fürth; Gerhard Kordel, Nurnberg, both of Fed. Rep. of Germany

[73] Assignee: Dynamit Nobel Aktiengesellschaft, Troisdorf, Fed. Rep. of Germany

[21] Appl. No.: 732,298

[22] Filed: May 9, 1985

[30] Foreign Application Priority Data

May 11, 1984 [DE] Fed. Rep. of Germany ..... 3417614

[51] Int. Cl.[4] ..... F41C 19/12

[52] U.S. Cl. ..... 42/84; 89/28.05

[58] Field of Search ..... 42/84; 89/28.05; 102/209, 206, 472

[56] References Cited

U.S. PATENT DOCUMENTS

| | | | |
|---|---|---|---|
| 2,459,854 | 1/1949 | Swift, Jr. | 42/84 |
| 3,809,964 | 5/1974 | Ceyrat | 89/28.05 |
| 4,145,968 | 3/1979 | Klein | 102/206 |
| 4,207,796 | 6/1980 | Warnock | 89/28.05 |
| 4,350,096 | 9/1982 | Cannavo et al. | 42/84 |
| 4,445,434 | 5/1984 | Brede et al. | 102/206 |

*Primary Examiner*—Charles T. Jordan

*Attorney, Agent, or Firm*—Antonelli, Terry & Wands

[57] ABSTRACT

A breech mechanism for a gun is equipped with an inductive ignition energy transmission system for ammunition with primer means comprising a secondary winding, a fixed housing, and a movable breech with at least one primary winding with core. The primary winding is arranged in the fixed housing. Magnetically conductive transmission elements are arranged in the movable breech in such a way that they couple magnetically, as a magnetic yoke, the primary winding to the secondary winding within the primary means.

11 Claims, 13 Drawing Figures

BREECH MECHANISM FOR A GUN WITH INDUCTIVE IGNITION ENERGY TRANSMISSION SYSTEM

This invention relates to a breech mechanism for a gun with an inductive ignition energy transmission system for ammunition with primer means including a secondary winding with a fixed housing and with a movable breech having at least one primary winding with core.

Devices for the noncontactual transmission of electrical energy for pyrotechnical detonators, especially in electrically controllable weapons are known from DOS No. 2,734,169 and DOS No. 3,024,554. The electrical ignition energy in these arrangements is transmitted without contact in accordance with the transformer principle, the loading chamber of the ammunition being hermetically sealed by a fixed partition of nonmagnetic material. The primary system for energizing the secondary winding in the primer cap is accommodated in the breech mechanism of the weapon in these conventional systems.

However, these known systems exhibit a number of disadvantages, that is:

1. Since the primary winding is in the breech of the gun, magnetic coupling of the primary to the secondary can take place only with the interposition of a solid breech block of a nonmagnetic material, on account of the required strength against the high stresses during firing; this makes the degree of efficiency of the energy transmission extremely poor.

2. The primary winding proper and/or the hollow space surrounding same in the gun breech leads to a weakening of the mechanical strength of the entire breech mechanism.

3. The conductive connection between the primary winding and the electronic gun control unit connected in front thereof must be movably entrained by the complete breech part and is subjected to high mechanical stress while feeding ammunition and during firing, especially in case of machine guns, which can lead to trouble.

4. Time-consuming replacement work must be performed in the gun breech in case of functional disturbances of the transmission system, especially in the primary winding with its leads.

5. Checking of the gun breech with respect to its instantaneous position and its wear condition can only be conducted by extremely expensive additional means.

Starting with the above-discussed state of the art, it is an object of the present invention to contruct a breech mechanism for a gun in such a way that the reliability of the gun equipped therewith is enhanced.

This object has been attained by a breech mechanism for a gun wherein at least one primary winding is arranged in the fixed housing and magnetically conductive transmission elements are disposed in the breech mechanism so that the elements inductively couple, as a magnetic yoke, the primary windings to the secondary winding.

On account of the arrangment, according to this invention, of one or several primary windings in the fixed housing; with the movable breech containing merely "passive" magnetically conductive transmission elements, the breech is no longer subject to mechanical weakening, moreover, it is no longer necessary to apply the supply voltage for the primary windings to the movable breech mechanism, which mechanism thus needs to be replaced only very rarely. At the same time, the gun breech constructed according to this invention can be monitored with respect to its instantaneous position and also with respect to its wear condition since the primary winding(s) represent(s) one (or more) inductive measuring probe(s) in conjunction with the magnetically conductive transmission elements in the breech, which probe(s) can be utilized in a manner known per se.

Since, as is known, there is the danger of eddy current losses in inductive transmission systems, the nonmagnetic material surrounding the elements transmitting magnetic energy is selected and/or structured advantageously in such a way that a high electric resistance is present at least in a direction perpendicular to the acting magnetic lines of force. This can be accomplished, on the one hand, simply by choice of material; on the other hand, layered arrangements are also suitable for this purpose, exhibiting at regular intervals layers of low conductivity or, alternatively, having high electric resistance at the junction surfaces.

This sandwich construction furthermore facilitates the manufacture of the breech mechanism, in particular, since the breech must not exhibit any "flawed areas" in view of the high stresses occurring.

The method of explosive plating is advantageously employed in order to firmly join the various layers which optionally consist of differing materials.

If only one primary winding is utilized, then the position of the breech mechanism with the magnetic transmission elements arranged therein can be ascertained simply by measuring the inductance of the winding since the winding is concomitantly determined by the position of the magnetic transmission elements in the breech mechanism relative to the winding core. Furthermore, conclusions can be drawn regarding the wear condition of the breech mechanism from the inductance of the winding when the breech is closed, inasmuch as the air gaps between the core of the primary winding and the magnetic transmission elements in the breech will be different in case of wear and tear.

The above-described measuring method is also applicable, of course, in case of a system having several primary windings. However, in such systems one of the windings is advantageously utilized as the transmission coil for a measuring signal; one or several additional windings are used as receiver coils. The thus-produced arrangement can be employed in a similar manner as a differential transformer measuring probe.

Due to the fact that several primary windings can be readily located in the housing of the gun, it is possible to build up a redundant system wherein energy adequate for ignition can be transmitted even if all primary windings, except one, become inoperative.

Preferred embodiments of the present invention will be described in greater detail hereinafter with reference to the drawings wherein.

Figure 1:
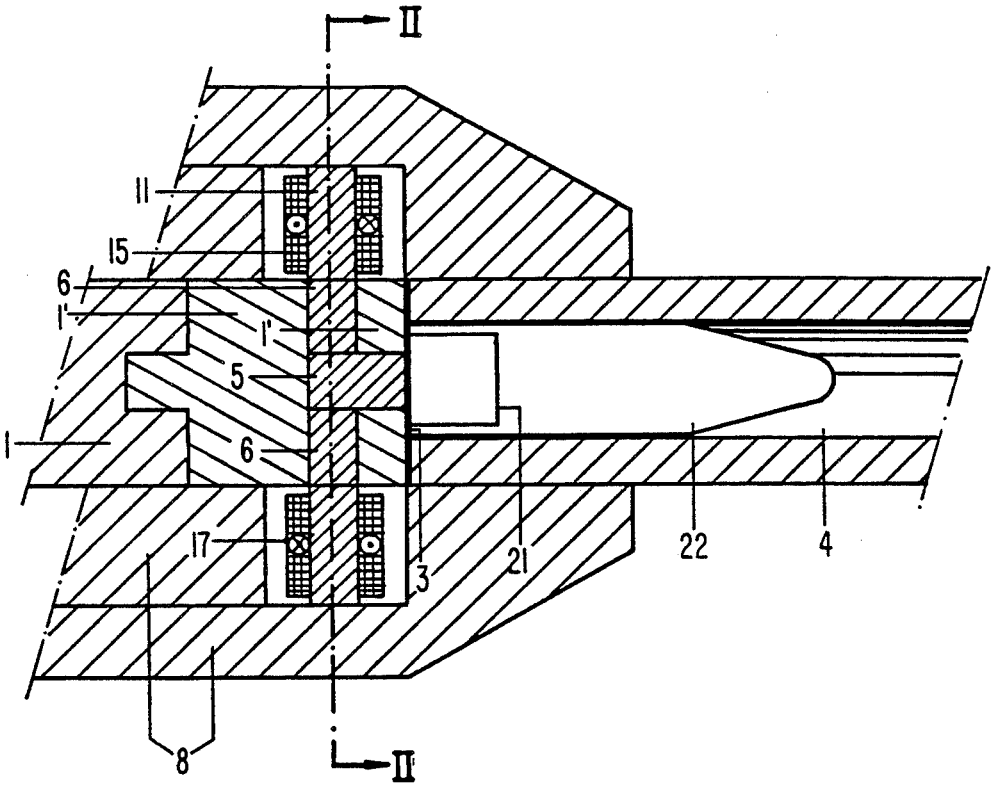
FIG. 1 shows a longitudinal sectional view of a first embodiment of the invention.

In all figures, 1 denotes a rear part, 1' denotes a nonmagnetic part, and 3 denotes the breech block of the breech mechanism. The breech 1 is seated in the housing 8 of the gun so that it is movable, namely displaceable toward the left as seen in the drawings. A cartridge 22 is disposed in the cartridge chamber 4 and is provided with a primer cap 21 containing the secondary winding with core and the electric primer means.

A first preferred embodiment of the invention will be described below in greater detail with reference to FIGS. 1 and 2. In this embodiment, a pressed-in pin 5 of a magnetically conductive material is located in the nonmagnetic insert 1' of the breech, concentrically to this insert; the strength of this pin is so high that the firing stress cannot cause any deformation. The pin 5 forms a plane with the nonmagnetic breech block 3. The pin 5 is supported by the nonmagnetic insert 1'. Four round rods 6 of a magnetically conductive material are pressed, in the radial direction of the breech, into the nonmagnetic insert 1' at an angular spacing of 90° from one another and with respect to the pin 5. The round rods 6 and the pin 5 are adapted to one another geometrically in such a way that there is no air gap produced between the pin 5 and each round rod 6; accordingly, the magnetic losses remain small.

In all figures, the breech mechanism is shown in the completely closed condition, i.e. ready for firing. In this position, the rods 6 are located in exact opposition to the cores 11 of the primary windings 15–18 are connected to the gun housing 8 of magnetically conductive material. In this particularly simple construction, the magnetic circuit is thus extended via the pin 5, the round rods 6, the cores 11, and the gun housing 8 to the core (not shown) of the secondary winding in the primer cap 21, the magnetic flux being coupled in, on the one hand, axially by way of the pin 5 and, on the other hand, radially by way of the gun housing 8.

Figure 2:
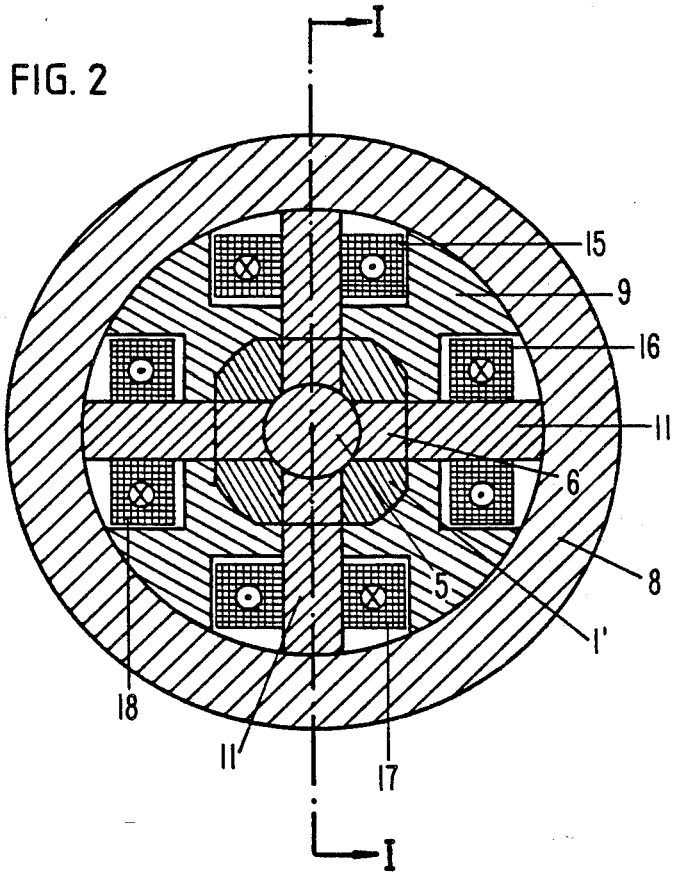
FIG. 2 shows a cross section along line II—II in FIG. 1.

Advantageously, in order to strengthen the gun housing in the zone of the primary windings 15–18, the portion that does not have to be available for the primary windings 15–18 is filled up by nonmagnetic material 9 (see FIG. 2). The material 9 may be the same as for the insert 1'. Since this material surrounds the cores 11, and the nonmagnetic material 1' surrounds the round rods 6, care must be taken that this material, at least in a direction perpendicular to the magnetic flux, exhibits low electric conductivity since otherwise the nonmagnetic material acts like a short-circuit winding, which entails high losses.

Figure 3:
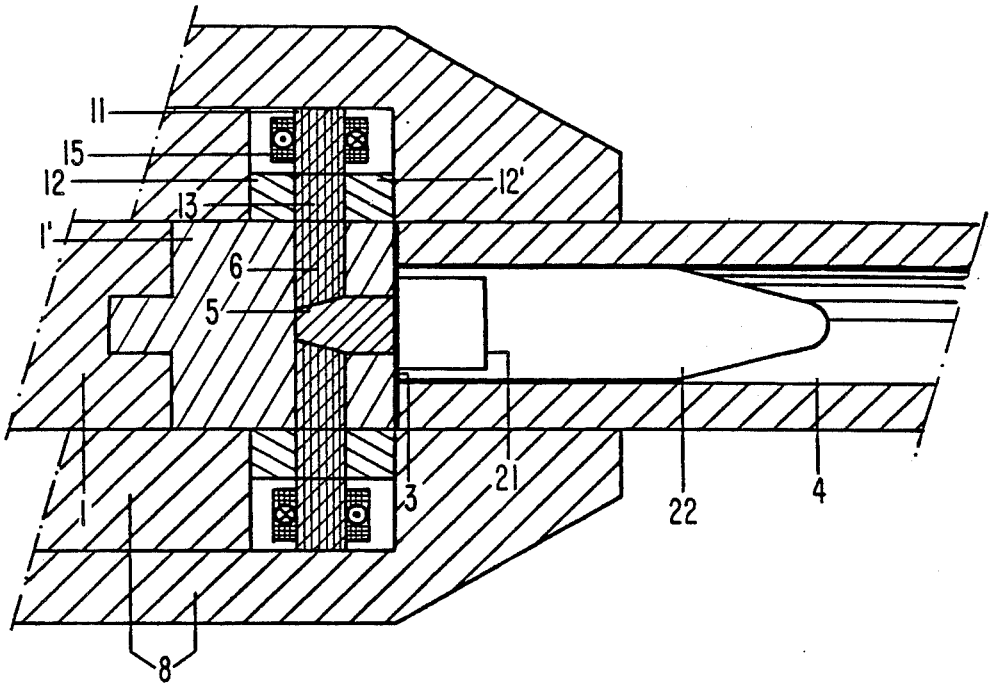
FIG. 3 shows a second embodiment of the invention with a guard ring.

Another preferred embodiment is illustrated in FIG. 3. In this arrangement, on the one hand, the radial branches 6 of the magnetically conductive transmission elements are constituted by a single, essentially circular plate constructed in lamination mode to avoid magnetic reversal losses. The single laminates of the plate have e.g. a thickness of $\leqq 0.1$ mm and are fixed together by an insulating glue. In this plate 6 is disposed the pin 5, coaxial to the breech, this pin having a conical shape to achieve an especially firm connection at its end locking into the plate 6. The pin 5 can, of course, also be constructed again in laminated fashion; in this case, it is possible to provide layers which are coaxial to the breech, or also small rods firmly joined together (for example of hexagonal cross section).

In this embodiment, another, substantially rotationally symmetrical guard ring is arranged between the breech mechanism 1, 1' and the primary windings with cores 11; this guard ring consists of layers of magnetically nonconductive material 12, 12' and magnetically conductive material 13. The layers 12, 12', 13 are again preferably built up as a laminated structure whereby, on the one hand, the aforementioned eddy current losses and, on the other hand, magnetic reversal losses in the components are kept at a low level. In this structure, an especially good seal of the breech is ensured with respect to the primary windings 15–18.

The winding cores 11 are designed as laminated stacks, as usual in transformer contruction, in the example illustrated in FIG. 3. This structure is, of course, essentially suited for all embodiments illustrated herein.

Figure 4:
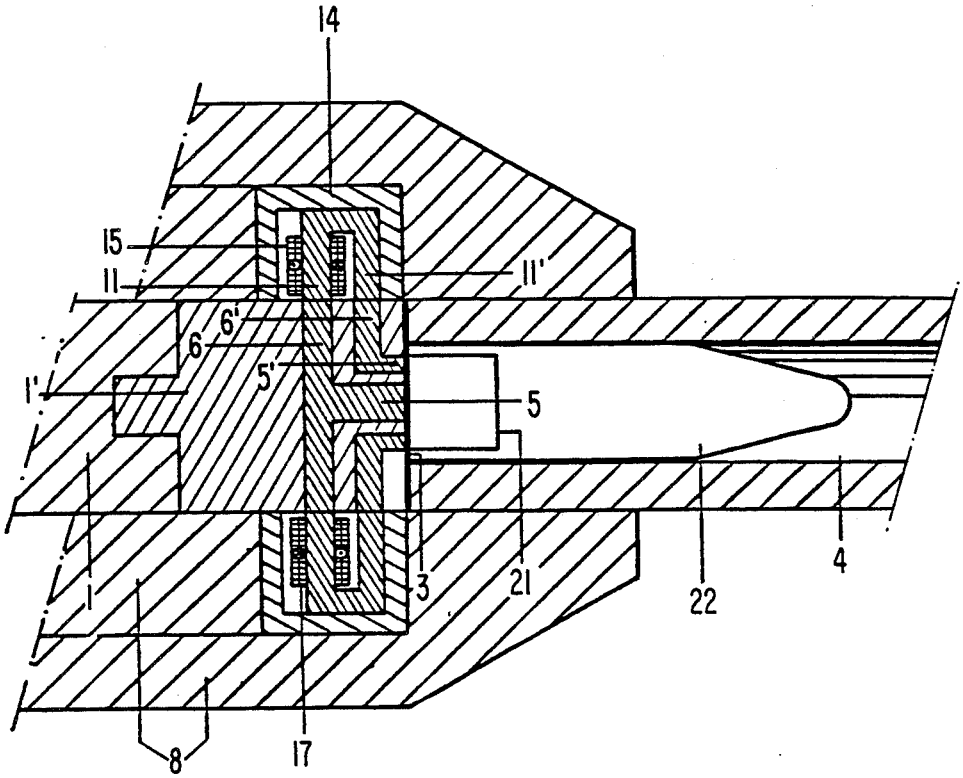
FIG. 4 shows a third preferred embodiment of the invention in a "bipolar" arrangement.

Another preferred embodiment is shown in FIG. 4 in a longitudinal sectional view. In this arrangement, the magnetic flux is not conducted via the gun housing 8, as in the examples of FIGS. 1–3, but rather is coupled in a "bipolar" fashion through the breech 1 and/or its nonmagnetic sections 1' in the axial direction into the primer cap 21. The windings 15–18 are seated, for this purpose, on cores having U-shaped cross section, the two legs 11, 11' of which are spaced apart from each other in the axial direction. With the breech being closed, the rearward winding core 11 is opposed to the radial branch 6 which is in magnetically conductive connection with the coaxial pin 5. The leg 11' is located in opposition to the radial branch 6' of another magnetically conductive transmission element which terminates in an axial branch 5', the latter likewise terminating planar with the breech block 3.

The windings 15–18 with their cores 11, 11' are shielded from the gun housing 8 by a layer 14 of a material that is magnetically non-conductive.

Figure 5:
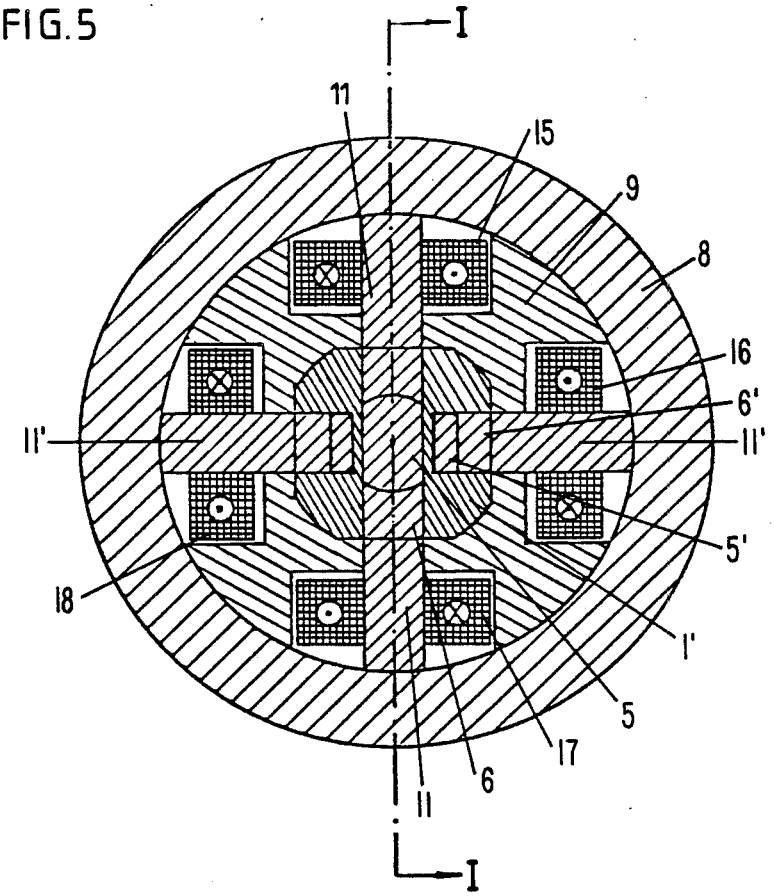
FIG. 5 shows a horizontal section along line II—II in FIG. 1, but in "bipolar" arrangment.

In the embodiment shown in FIG. 5, a bipolar arrangement is again illustrated, the longitudinal section thereof corresponding to that of FIG. 1. As compared with the embodiment of FIG. 4, however, the two magnetic poles in the embodiment shown in FIG. 5 are not spaced apart in the axial direction but rather lie in the same cross-sectional plane and are separated from each other by an angular spacing. In this arrangement, the connection between the cores 11, and 11' at their one end is established by way of the gun housing 8. In order to avoid losses, it is again advantageous herein to establish the connection, instead of by way of the gun housing 8, via a separate ring of a magnetically conductive material which is shielded with respect to the gun housing 8 by a layer 14 of a magnetically nonconductive material (see FIG. 4). In the embodiment of FIG. 5, the windings 15 and 17 are, therefore, wound in the same direction, the windings 16 and 18 are wound in the reverse direction, while in all previously illustrated arrangements the windings are wound in the same direction.

Figure 6:
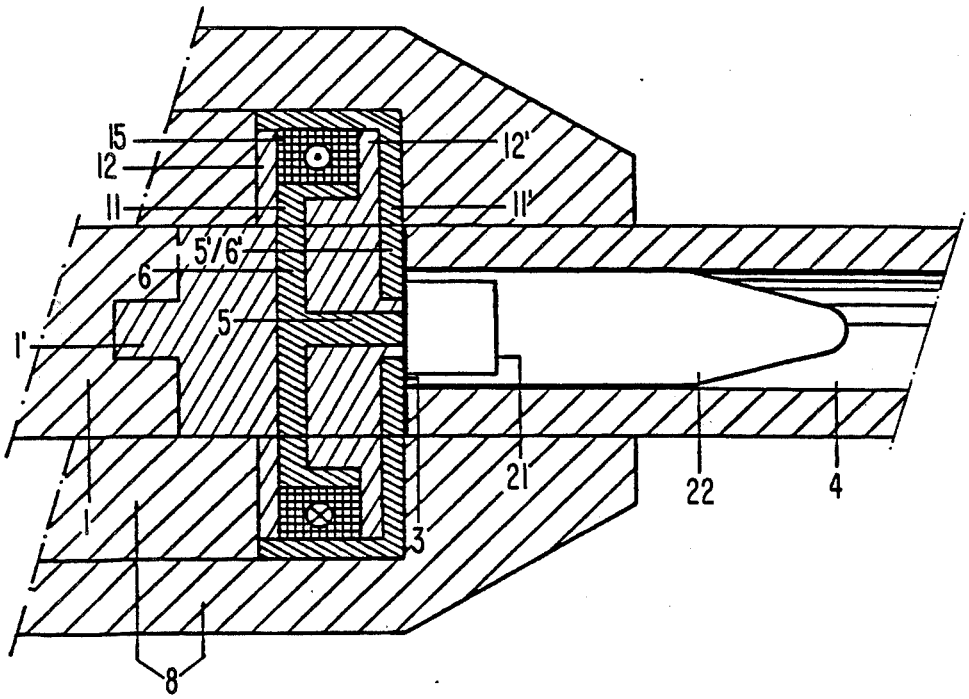
FIG. 6 shows a fourth preferred embodiment of the invention with a single primary winding.

Another preferred embodiment is shown in FIG. 6. In this embodiment, the breech mechanism 1, 1' is surrounded by a single winding 15, the magnetic field of which is coupled by cores 11, 11' into the magnetically conductive transmission elements 5, 6 and 5', 6' respectively. Also in the embodiment it is advantageous if the primary winding 15 with cores 11 and 11', just as shown in FIG. 4, is separated from the gun housing by means of a shield 14 of a magnetically non-conductive material.

In order to facilitate understanding of the previously illustrated sectional views, the perspective FIGS. 7–10 are provided which will be described below. In these drawings, the longitudinal sections through the breech mechanisms according to FIGS. 7 and 9 and through the primary winding arrangements, 8 and 10, convey a picture corresponding to FIG. 4.

Figure 7:
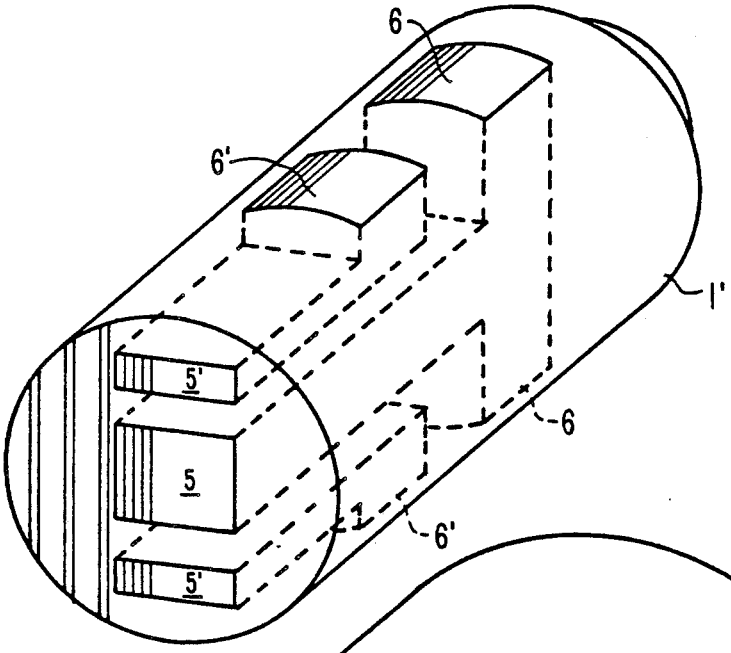
FIG. 7 shows a perspective view of a breech part, similar to that according to FIG. 4.

FIG. 7 illustrates how the transmission elements of magnetically conductive material can be built up in a sandwich structure just like the forward breech part 1' of nonmagnetic material. By appropriate combinations of materials, it is herein possible, on the one hand, to reduce the eddy current losses in the nonmagnetic material 1'; on the other hand, the magnetic reversal losses can be minimized in the magnetically conductive transmission elements. For joining the layers together, the explosive plating technique is quite excellently suitable, permitting a high-strength bond even between materials that otherwise can be joined only with difficulties. In this way, it is possible to produce a breech mechanism with simultaneously especially good electrical, magnetic, and mechanical properties.

Figure 8:
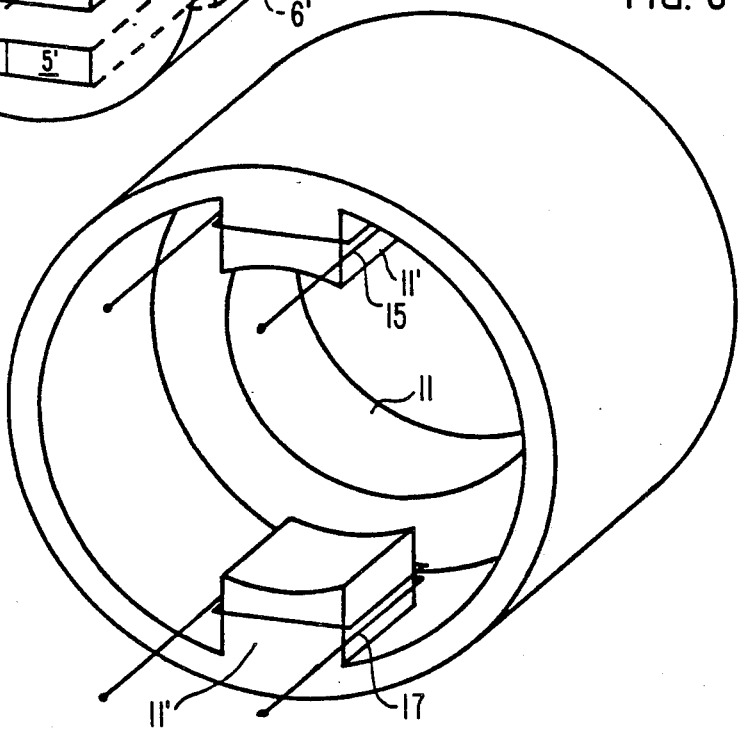
FIG. 8 shows a perspective view of a primary winding core, similar to the arrangement of FIG. 4.

FIG. 8 illustrates a preferred embodiment of the primary winding core wherein the windings 15, 17 are seated on cores 11 joined by a tubular yoke with the circular-ring-shaped core section 11'.

Figure 9:
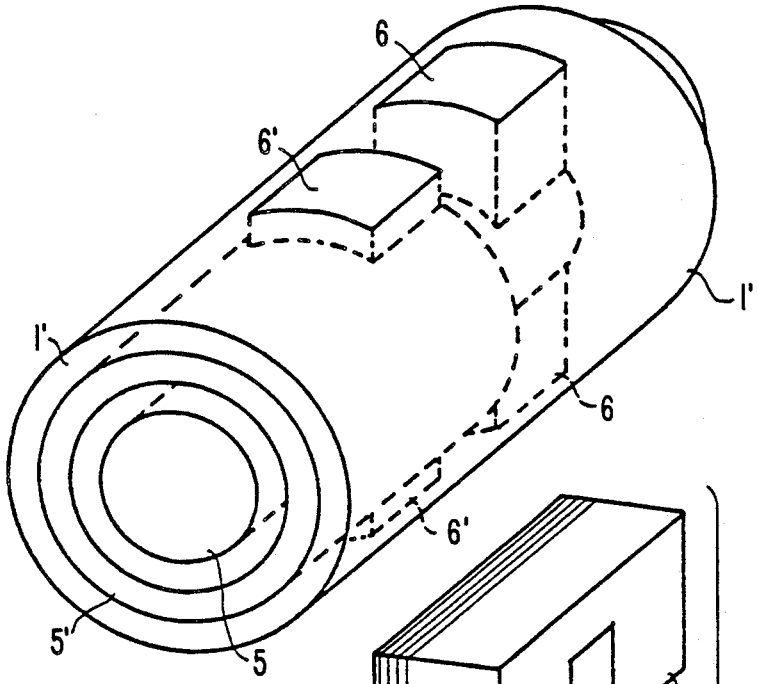
FIG. 9 shows a perspective view of another embodiment of a breech part similar to FIG. 7.

In FIG. 9, another preferred embodiment of the breech part is illustrated wherein circular-ring-shaped pole shoes 5, 5' are produced by the coaxial arrangement. It is, of course, also possible in this example to fashion the radial branches 6, 6' of the magnetically conductive transmission elements of a circular ring shape, rather than of the shape illustrated, so that a completely axially symmetrical arrangment is produced.

Figure 10:
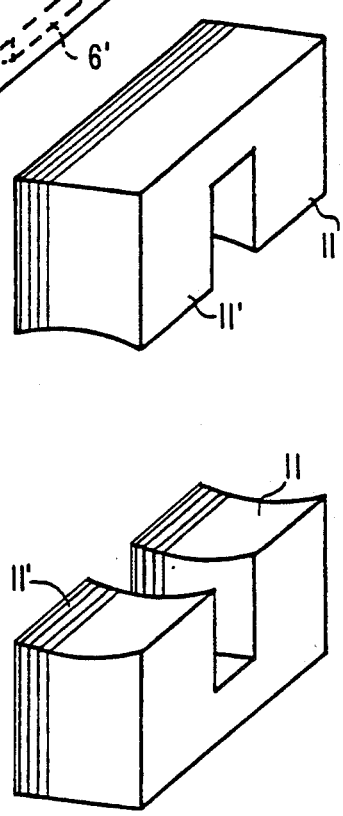
FIG. 10 shows another embodiment of a primary winding core similar to FIG. 8.

FIG. 10 shows, for the sake of completeness, the structure of laminated primary winding cores, as the are advantageously employed in the embodiments corresponding to FIG. 4.

Figure 11:
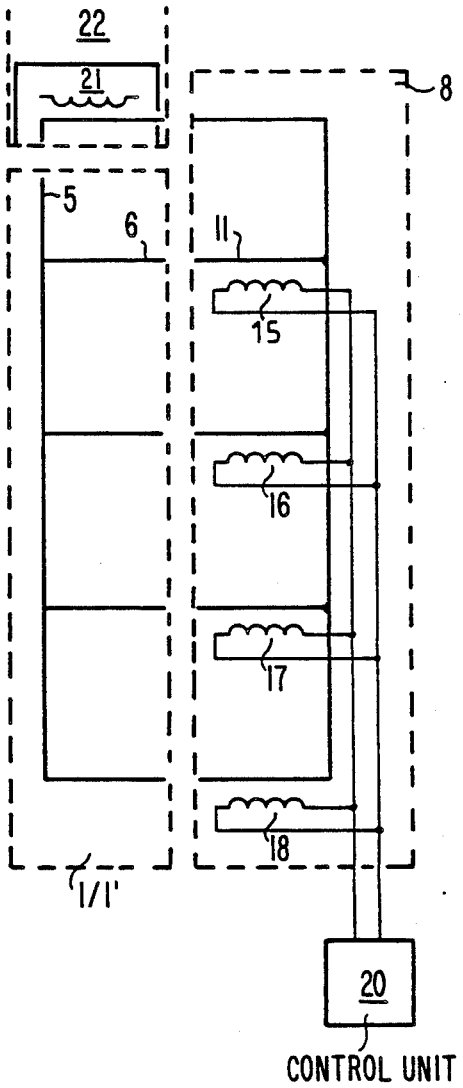
FIG. 11 shows a circuit diagram, in principle, of a "unipolar" arrangement.

FIG. 11 shows the structure, in principle, of the unipolar embodiment of the gun breech of this invention. It can be seen from this figure that the primer cap 21 in the cartridge 22 contains a secondary winding, the core of which terminates axially with one pole, radially with the other pole. The axial pole shoe 5 and the radial pole shoe formed by the gun housing 8 are located in opposition to the two magnetic poles of the secondary winding. It can also be seen from this illustration that the breech mechanism 1, 1' contains only passive components, namely the magnetically conductive transmission elements 5 and 6, whereas the gun housing 8 contains the primary windings 15–18 with the associated cores 11—the most sensitive parts of the device. In the example shown in FIG. 11, the primary windings 15–18 are already connected in the gun housing 8 to be electrically and magnetically in parallel. Due to this connection, a redundant system is created if the primary windings are supplied so that the magnetic field of a single primary winding is strong enough for providing the necessary ignition energy.

The primary windings 15–18 are connected to the electronic gun control unit of device 20. This gun control unit comprises, on the one hand, a source of alternating current yielding the power required for energizing the primary windings. On the other hand, the gun control device 20 contains measuring devices by means of which the operating condition and the wear condition of the breech system can be checked. Suitable for this purpose is an inductance measuring system in case of an arrangement with only a single primary winding, or with several primary windings connected in parallel in the gun housing. The inductance of the primary windings changes, in such arrangment, with the position of the breech mechanism 1, 1' and/or the pole shoes 6 with respect to the gun housing 8 and/or with respect to the primary winding cores 11. By measuring the inductance of the primary windings by means of a high-frequency alternating current of very low energy (to avoid premature ignition), a control signal can be produced upon reaching a maximum of inductance, this signal with the identification "breech closed" releasing the alternating current generator for generating the ignition energy.

Furthermore, due to wear and tear, the air gap is changed between the magnetic poles 6 and 11, likewise leading to a reduction of the inductance of the primary windings. In order to be able to monitor the wear condition of the breech mechanism, is it thus merely necessary, after inserting a new breech mechanism, to fix a reference level of inductance without cartridge being inserted, for example by a digitally presettable potentiometer, and the wear condition of the breech mechanism can subsequently be determined with the aid of this value.

Figure 12:
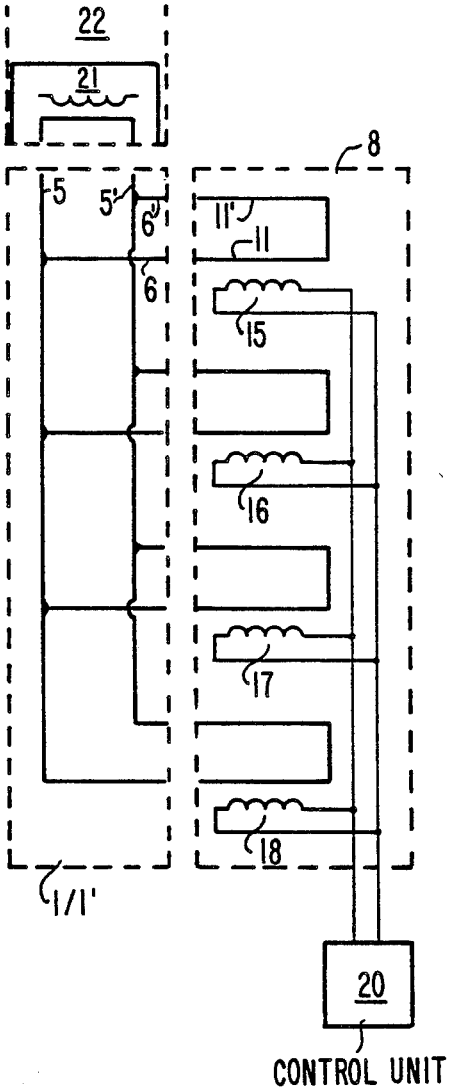
FIG. 12 shows a circuit diagram, in principle, of a "bipolar" arrangement with several parallel-connected primary windings.

FIG. 12 shows the bipolar embodiment of the gun breech mechanism of this invention in a schematized form wherein the electric interconnection of the primary windings 15–18 is identical to that of FIG. 11. It can be seen from this figure that the entire magnetic energy is transmitted by the transmission elements of magnetically conductive material in the gun breech mechanism 1, 1', i.e. the gun housing 8 is not limited to materials of sufficient magnetic conductivity. Yet, this embodiment likewise contains merely "passive" components in the breech, namely magnetic yokes.

Figure 13:
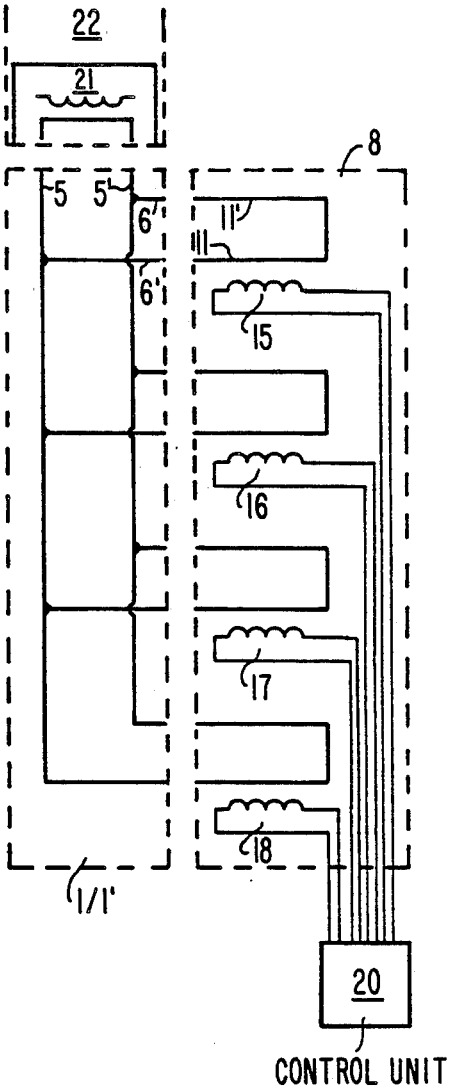
FIG. 13 is a circuit diagram similar to FIG. 12 but with primary winding terminals connected separately into the control unit.

The circuit arrangement according to FIG. 13 corresponds in magnetic respects to that of FIG. 12, but the leads to the primary windings 15–18 are respectively conducted separately into the gun control unit 20. With a correspondingly high volume of circuitry, it is, of course, also possible to connect respectively one terminal pole of the primary windings jointly via the gun housing 8.

In the embodiment of the electric circuitry shown in FIG. 13, another possibility for checking the breech with regard to its position and its wear is presented. It is possible herein, with primary windings usable separately from one another, to utilize a least one of the windings as a transmitter coil for an alternating measuring field, and the other windings as receiver coils. In this way, measuring of the breech position is possible in accordance with the differential transformer principle.

Furthermore, the wear condition of the breech mechanism can be measured by measuring the inductances of the individual windings; in this connection, a differential inductance measurement between two mutually opposed windings is especially suitable for obtaining a sensitive measuring system.

It is moreover also possible, when using several primary windings, to test the operating condition of the inductor coils proper by using an excitation winding, or to utilize alternatively one of the primary windings for controlling the firing impulse.

It is thus possible by the arrangement of this invention to produce a gun breech mechanism which, in total, is especially safe in operation, attaining this high operating safety by a sum total of individual features enhancing one another in their efforts.

What is claimed is:

1. A gun breech mechanism with an inductive ignition energy transmission system for ammunition with electrical primer means comprising a secondary winding, a fixed housing, a movable breech and at least one primary winding with core the at least one primary winding being arranged in the fixed housing, and magnetically conductive transmission elements being disposed in the breech so that the elements inductively couple, as a magnetic yoke, the at least one primary winding to the secondary winding within the primer means.

2. The gun breech mechanism according to claim 1, characterized in that the breech is built up of nonmagnetic material at least in the zone containing the transmission elements.

3. The gun breech mechanism according to claim 2, characterized in that the nonmagnetic material has a high electrical resistance at least in a direction perpendicular to the effective magnetic lines of force.

4. The gun breech mechanism according to claim 1 characterized in that the transmission elements include radially arranged round rods and an axially arranged pin.

5. The gun breech mechanism according to claim 1 characterized in that each of said transmission elements include a circular disk and a pin.

6. The gun breech mechanism according to claim 1, characterized in that the breech, in the zone containing the transmission elements is formed with a plurality of parts arranged in a sandwich structure.

7. The gun breech mechanism according to claim 6, characterized in that the parts of the sandwich structure are joined by means of explosive plating.

8. The gun breech mechanism according to claim 1 characterized in that the at least one primary winding is connected with a circuit control means for testing the closed condition and the primary winding.

9. The gun breech mechanism according to claim 1, characterized in that several primary windings are arranged in an electrical and magnetic parallel connection, at least during ignition.

10. The gun breech mechanism according to claim 1, characterized in that the at least one primary winding is connected with a circuit control means for testing the closed condition.

11. The gun breech mechanism according to claim 1, characterized in that the at least one primary winding is connected with a circuit control means for testing the primary winding.

* * * * *